United States Patent [19]

Ottenhues et al.

[11] 4,063,504

[45] Dec. 20, 1977

[54] APPARATUS FOR APPLYING AND WITHDRAWING AN IMPRESSION CYLINDER ACTING ON THE PLATE CYLINDER OF AN INTAGLIO PRINTING PRESS

[75] Inventors: Ludger Ottenhues, Riesenbeck; Willi Meyer, Ibbenburen, both of Germany

[73] Assignee: Windmoller & Holscher, Lengerich, Germany

[21] Appl. No.: 774,456

[22] Filed: Mar. 4, 1977

[30] Foreign Application Priority Data

Mar. 8, 1976 Germany ..... 2609513

[51] Int. Cl.[2] ..... B41F 9/00

[52] U.S. Cl. ..... 101/153; 101/247

[58] Field of Search ..... 101/152, 153, 154–157, 101/182, 184, 185, 247

[56] References Cited

U.S. PATENT DOCUMENTS

| | | | |
|---|---|---|---|
| 2,207,785 | 7/1940 | Crafts | 101/153 |
| 2,607,292 | 8/1952 | Harless et al. | 101/153 |
| 3,131,631 | 5/1964 | Haskin, Jr. | 101/247 X |
| 3,272,122 | 9/1966 | Behringer | 101/153 |
| 3,601,046 | 8/1971 | Motter | 101/247 |

*Primary Examiner*—J. Reed Fisher

*Attorney, Agent, or Firm*—Fleit & Jacobson

[57] ABSTRACT

In an intaglio printing press where the impression cylinder is provided with two journals for mounting it in the frame of the press, the journals being operatively connected to respective screw-threaded spindles which are adjustable in unison or independently, apparatus for applying and withdrawing the impression cylinder to and from the plate cylinder comprises first and second rotatable nuts mounted on each spindle, the two nuts on each spindle being coupled for co-rotation. A hand wheel is operatively connected to said first nut to apply same to a respective abutment surface that is fixed with respect to the frame. A piston-cylinder unit is operatively connected to each said second nut to lift and lower same, the psiton-cylinder unit being supplied with pressure medium through independent fine control valves.

8 Claims, 5 Drawing Figures

APPARATUS FOR APPLYING AND WITHDRAWING AN IMPRESSION CYLINDER ACTING ON THE PLATE CYLINDER OF AN INTAGLIO PRINTING PRESS

The invention relates to an apparatus for applying and withdrawing an impression cylinder that acts on the plate cylinder of an intaglio printing press, wherein the two journals of the impression cylinder are connected to screw-threaded spindles which can be set separately or in unison by means of nuts rotatable by a hand wheel acting through transmission shafts and gearing, piston-cylinder units being provided to lift or lower the nuts.

Intaglio printing presses are suitable for printing webs of paper, cardboard as well as thin film. Thin film, particularly if it consists of plastics material, is very sensitive to high pressure loads because of its extreme flexibility. Webs of thin film can therefore be printed only when the impression cylinder makes light contact with the plate cylinder, the contacting force being generally less than the weight of the impression cylinder. In contrast, webs of heavy paper call for a full contacting force between the impression and plate cylinders.

To obtain a good printed impression and enable the impression cylinder to be pressed against the plate cylinder under a pressure that is most favourable for a particular material that is being printed, it is therefore necessary to make provision for adjusting the contacting pressure within close limits.

In an apparatus known from U.S. Pat. No. 3,131,631, the nuts for operating the screw-threaded spindles are mounted in carriers which are pivotable about an axis parallel to the rotary axis of the impression cylinder so that they can be applied or withdrawn by the piston-cylinder units. Each carrier is supported against fixed abutments in the applied condition of the impression cylinder. However, there is no provision for finely adjusting the force with which the impression cylinder is applied to the plate cylinder. There is a certain amount of play between the nuts and the screw-threaded spindles engaged therein and consequently the known apparatus cannot be used to set a contact force that is less than the weight of the impression cylinder. Further, the forces applied by the piston-cylinder units cannot be set independently, whereby it is impossible to set different forces between the impression and plate cylinders at their respective ends, which is often desirable if the engraving of the plate cylinder is such that the printed impression is weaker at one end of the plate cylinder than at the other.

It is an object of the present invention to provide an apparatus that permits the impression cylinder to be applied to the plate cylinder with finely adjustable different forces across the width of the web to be printed.

According to the invention, two nuts coupled for co-rotation are mounted on each screw-threaded spindle, only one of the nuts being liftable and lowerable by the piston cylinder unit and the other being displaceable by the hand wheel towards an abutment surface that is fixed with respect to the frame, each piston-cylinder unit being supplied with pressure medium through independent fine control valves.

The apparatus of the invention permits ready play-free setting of the forces exerted by way of the nuts and spindles, as well as independent setting of the forces produced by means of the piston-cylinder units. Since in the apparatus of the invention each screw-threaded spindle is held between the two nuts without play, the force to be exerted by the impression cylinder can be set to be lower than the weight of the impression cylinder.

If a force is desired that is less than the weight of the impression cylinder, the nut operated by the hand wheel is moved up against the fixed abutment surface. The path followed by the force is then from the nut that is liftable and lowerable by the piston-cylinder unit to the screw-threaded spindle and from there to the nut that is adjustable by the hand wheel to the fixed abutment surface. By locking the nuts to each other, the spindle is held therebetween without play. When one of the nuts is up against the abutment surface, the screw-threaded spindle can be set without play so that, in a case of critical loading, that is to say at the transition between the force that is lower than the force corresponding to the weight of the impression cylinder and a force that is larger than same, setting of the impression cylinder can be achieved by constant further turning of the hand wheels or hand wheel. In this way, the setting from one pressure or loading to another of the same kind can be reliably repeated.

Feeding the piston cylinder units through independent control valves permits the necessary printing forces to be set with a larger force than that corresponding to the weight of the impression cylinder, i.e., at 'full load operation', merely by setting the control valves, without the need for actuating the hand wheels.

Preferably, the fine control valves are preceded by a base fine control valve. This prescribes a common basic force for the two piston-cylinder units and this basic force can be increased independently for each of the units by means of the individual control valves and thereby finely set.

A slide valve may be disposed in the path of that nut that can be applied to the fixed abutment surface, such slide valve serving to switch feeding of the piston-cylinder units with pressure medium at a high pressure to one at a lower pressure. This automatically ensures that, when the nut is up against the abutment surface, both piston-cylinder units operate with pressure medium at a lower pressure and the possibly differing pressures that were previously set for full load operation are eliminated so that there can be no elastic stressing of the entire system. This also improves the reproducibility of the impression cylinder setting.

For the purpose of adjusting both nuts in unison, the hand wheel may be coupled by step-down gearing to a scale moving past an indicator marking. This enables the setting of the hand wheel to be accurately read off even after several revolutions.

Desirably, the scale is graduated in fractions of the circumference of the plate cylinder so that the setting of the impression cylinder corresponding to the particular stereotype can be read off.

Further, the hand wheel may be coupled by gearing to a further scale which is graduated in fractions of the hand wheel revolutions and which is provided with indicator markings so that even fractions of the hand wheel revolutions can be read off.

The hand wheel can be retracted to a position in which only one of the nuts is driven and the gearing displaces an indicator marking towards the further scale, thereby enabling the relative position of one nut to the other or one end of the impression cylinder to the other to be read off.

The gearing may include locking means in the form of pins to limit the inclination of the impression cylinder to the plate cylinder.

Further aspects of the invention will become evident from the following description of an example with reference to the accompanying drawings, wherein.

Figure 1:
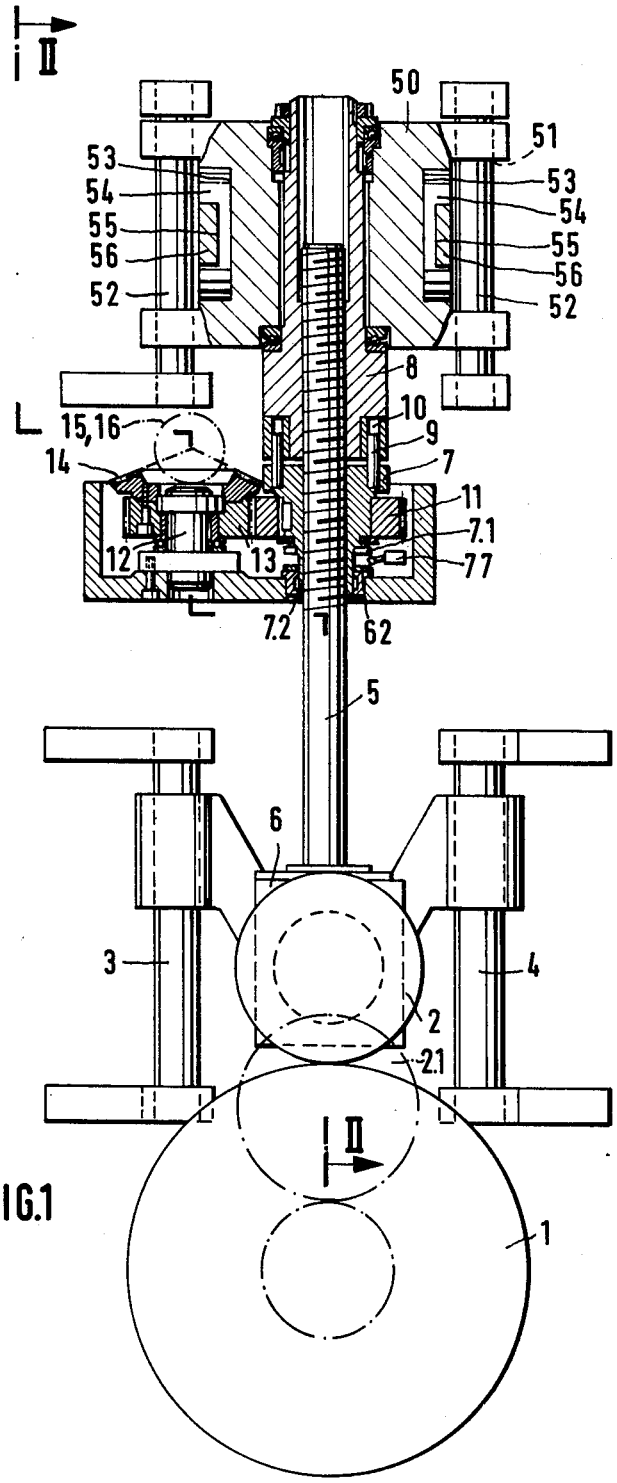
FIG. 1 is a cross-section through an intaglio printing mechanism.
Figure 2:
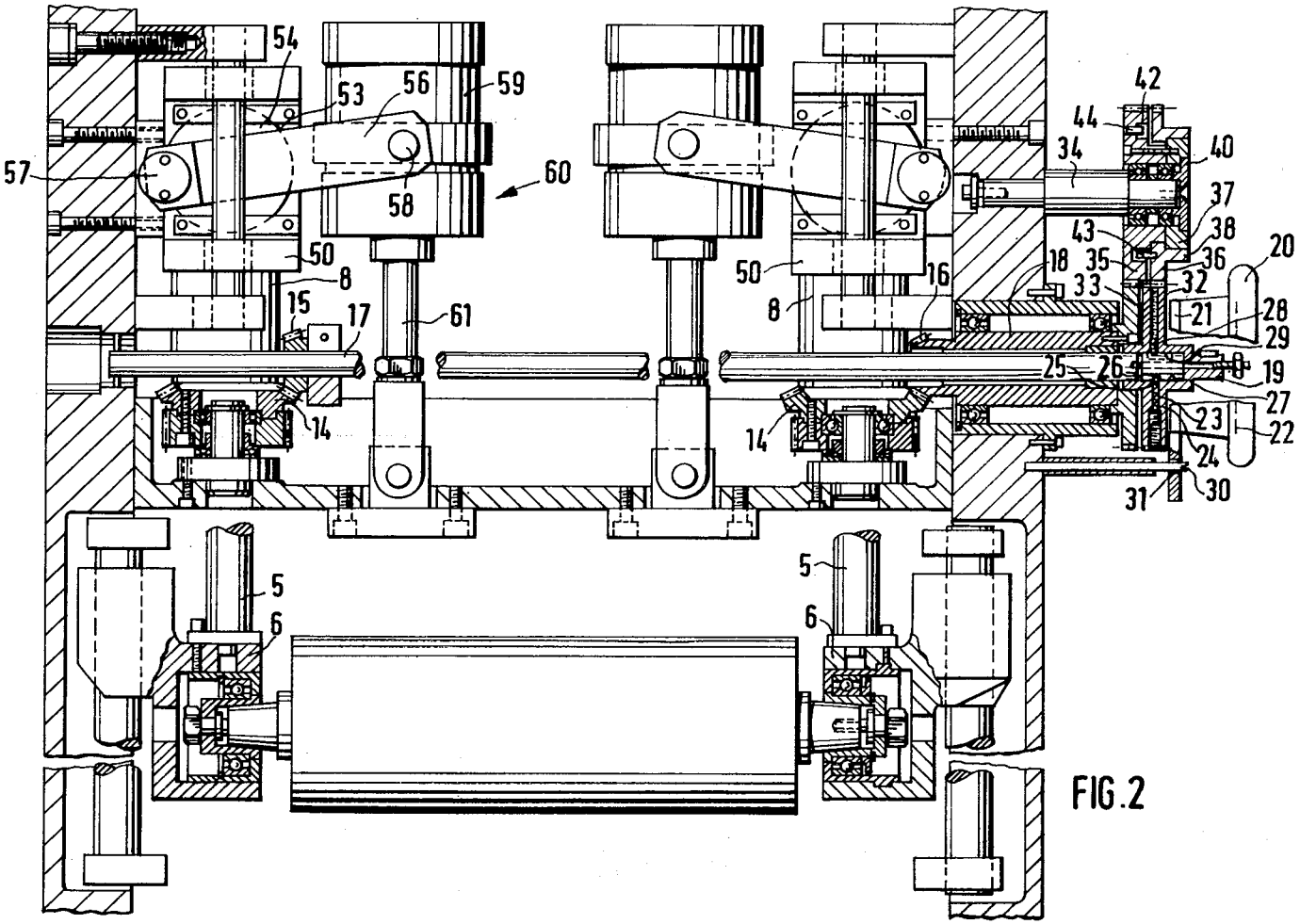
FIG. 2 is a section on the line II—II in FIG. 1.
Figure 3:
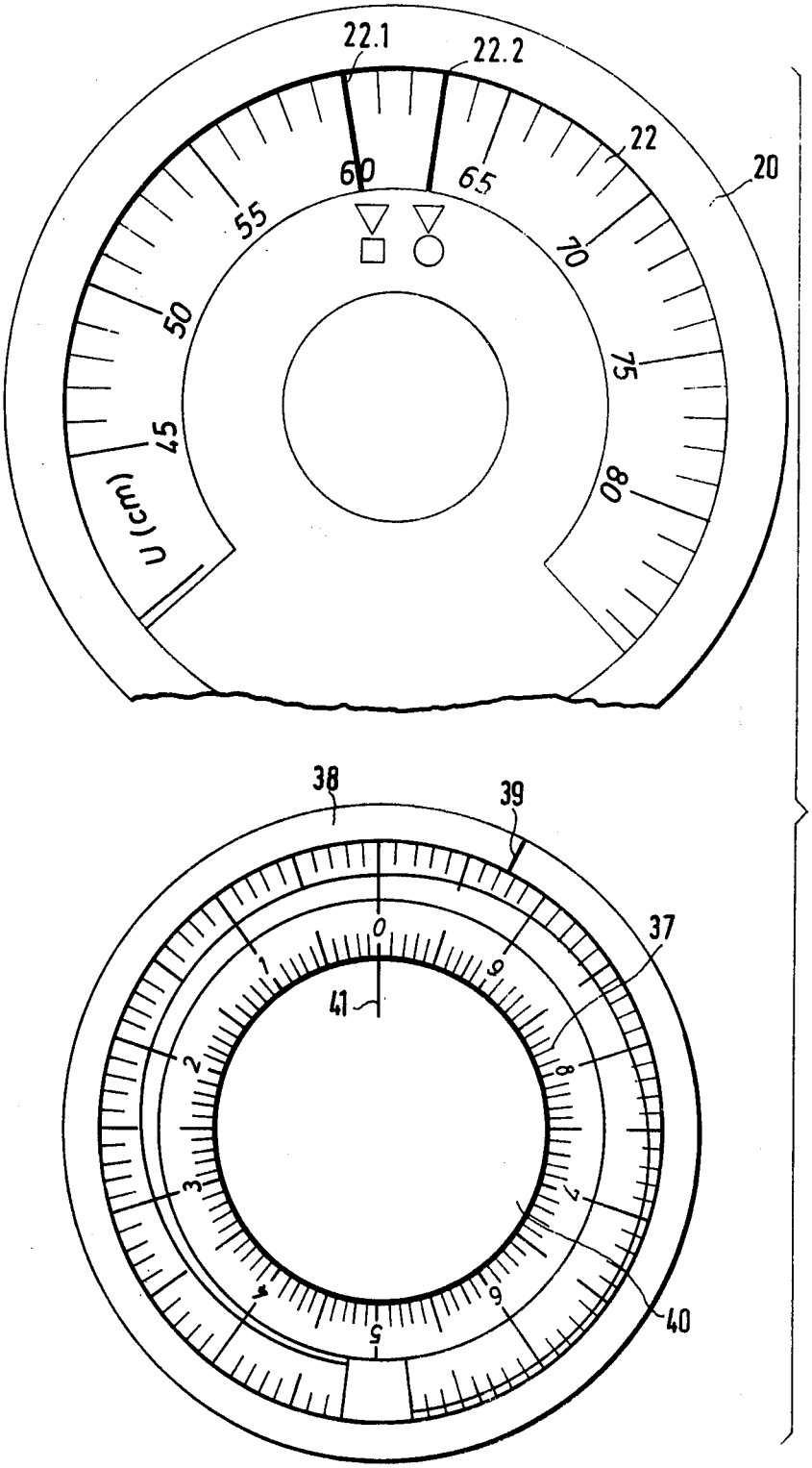
FIG. 3 is a plan view of the hand wheel and fine adjustment means.

A plate cylinder 1 is mounted in the frame of the press and is driven in known manner. It may have various circumferences. Its largest circumference is shown in full lines and its smallest circumference in chain-dotted lines. The web to be printed (not shown) is pressed against the plate cylinder 1 by an impression cylinder 2. Both ends of the impression cylinder 2 are rotatably mounted in bearings 6 which are vertically displaceable along guides 3, 4 that are fixed with respect to the frame. Corresponding to the smallest circumference of the plate cylinder 1, the impression cylinder 2 can assume a lowest position 2.1. For adjustment in the vertical direction, each end of the impression cylinder is associated with two screw-threaded spindles 5 secured to the housings of the bearings 6. Engaged on the spindles 5 there are nuts 7 and 8 that are movable with respect to each other in the axial direction corresponding to the play of the screwthread but are locked by pins 9 for co-rotation. The pins 9 are tightly seated in the nuts 7 and have a slide fit in holes 10 of the nut 8. Secured to the nuts 7 are gear rings 11 in mesh with gears 13 which are loosely rotatably mounted on shafts 12 that are fixed with respect to the frame. Bevel gears 14 are fixed to the gears 13. One of the bevel gears 14 engages a bevel gear 15 and the other a bevel gear 16. The bevel gear 15 is secured to a shaft 17 which is loosely rotatable in the frame. The bevel gear 16 is seated on a hollow shaft 18 which is slidably carried on the shaft 17. At the end of the shaft 17 projecting from the operating side of the press there is displaceably mounted a sleeve 19 to which a hand wheel 20 is secured. The hand wheel 20 accommodates step-down gearing of which the sun wheel 20.1 is loosely rotatable on the sleeve 19 and fixed for co-rotation to a plate 21.

Within the body of the hand wheel 20, loosely rotatable planet gearing 20.2, 20.3 and 20.4 has its planet gear 20.2 in mesh with the sun wheel 20.1. The sun wheel 20.1 and the planet gear 20.2 are disposed at the side of the press, i.e., at the back of the hand wheel 20, and the planet gears 20.3 and 20.4 are disposed at the front. The planet gear 20.3 is in mesh with a central gear 20.5 and the planet gear 20.4 is in mesh with a central gear 20.6. The two planet gears 20.2 and 20.3 have the same pitch circle diameter and the same number of teeth. The pitch circle diameters and numbers of teeth are also equal for the sun wheel 20.1 and the central gear 20.5. On rotation of the hand wheel 20, the planet gear 20.2 moves over the sun wheel 20.1 and the planet gear 20.3 moves over the central gear 20.5. By reason of the identical gearing geometry of these gears, the central gear 20.5 therefore remains stationary during rotation of the hand wheel 20.

The planet gear 20.4 has the same pitch circle diameter as the plate gear 20.2 or 20.3 but a different number of teeth. During rotation of the hand wheel 20, the central gear 20.6 therefore rotates relatively to the central gear 20.5.

A scale 22 graduated according to the circumference of the plate cylinder 1 is connected to the central gear 20.6 and two scale markings 22.1 and 22.2 which cover the scale 22 are connected to the central gear 20.5. On rotation of the hand wheel 20, the scale 22 therefore sweeps below the indicator markings 22.1 or 22.2.

The sleeve 19 together with the hand wheel 20 can be displaced on the shaft 17 in the axial direction and locked in two positions shown in full lines by means of a ball 25 which is disposed in a hole 23 of the sleeve 19 and pressed inwardly by a spring 24, and two detents 26, 27 provided in the surface of the shaft 17, the ball 25 engaging either in the detent 26 or the detent 27. Moving past the detents 26, 27 is prevented by a screw 28 which is inserted in the sleeve 19 and engages in a groove 29 milled in the shaft 17, the length of this groove corresponding to the spacing between the detents 26, 27. The plate 21 is centred on the sleeve 19 by means of a complementary hole and secured against rotation in both positions of the hand wheel 20 by means of a pin 30 which is fixed with respect to the frame and engages in a hole 31 of the plate 21.

At its periphery, the sleeve 19 comprises teeth 32. Secured to the hollow shaft 18 is a gear ring 33 of which the pitch circle is as large as the pitch circle of the teeth 32. Two gears 35, 36 are loosely rotatably mounted on a shaft 34 which is secured to the frame and is parallel to the shaft 17 or the hollow shaft 18. The gear 35 engages with the gear 33 and the gear 36 engages with the teeth 32 of the sleeve 19. In a retracted position of the hand wheel 20 with respect to the frame, the teeth 32 are also in mesh with the gear 35. In this position, both nuts 7 of the two screw-threaded spindles are rotated on turning the hand wheel 20 whereas in the retracted position of the hand wheel 20 only one nut 7 turns, namely the one driven by the bevel gear 15. A scale 37 is connected to the gear 35. A hollow cylinder 38 projecting from the gear 36 and flush with the scale 37 is provided with an indicator marking 39. A plate 40 carrying an indicator marking 41 is screwed to the shaft 34. Rotation of both nuts 7 can be read off at the indicator marking 41 on the scale 37 which is graduated in fractions of the scale 22 or fractions of the revolutions of the hand wheel 20. Rotation of one nut 7 relatively to the other is shown by the indicator marking 39 on the scale 37 in accordance with the described branching off of the drive. The gear 35 comprises an annular groove 42 in which there is engaged a pin 43 fixed to the gear 36. A pin 44 secured in the annular groove 42 or in the gear 35 limits further movement of the pin 43. Consequently, on further rotation of the hand wheel 20 the hollow shaft 18 and thus the nut 7 driven by the bevel gear 16 are also set in rotation, i.e., even if the teeth 32 are not in mesh with the gear 35 and the hollow shaft 18 were to stand still. This avoids the impression cylinder 2 being brought into an excessively oblique position relatively to the plate cylinder 1.

The nuts 8 are loosely rotatable in guide pieces 50 but are held fixed in the axial direction of the screw-threaded spindles 5 by means of axial bearings. The guide pieces 50 have holes 51 on both sides to be displaceable along guide pins 52 which are fixed with respect to the frame and parallel to the screw-threaded spindles 5. The guide pieces 50 are provided on both sides with machined recesses 53 in which discs 54 are loosely rotatable. The discs 54 comprise grooves 55 in which levers 56 are a slide fit. The levers 56 have one end 57 loosely rotatably hinged to the frame and the other end 58 hinged to the cylinder 59 of a piston-cylinder unit 60 of which the piston rod 61 is hinged to the frame of the press. Actuation of the piston-cylinder units 60 causes the guide pieces 50 and thus also the nuts 8 to be lifted or lowered.

At the ends of the nuts 7 facing the impression cylinder 7 there are abutment surfaces 7.1 which may be formed by axial roller bearings and lie against complementary surfaces 62 fixed with respect to the frame when the nuts 7 are screwed downwardly. Preferably, the fixed surfaces 62 are in the form of bushings guiding sleeve-like projections 7.2 of the nuts 7. This provides exact guiding of the spindles 5 and also the nuts 7.

Figure 4:
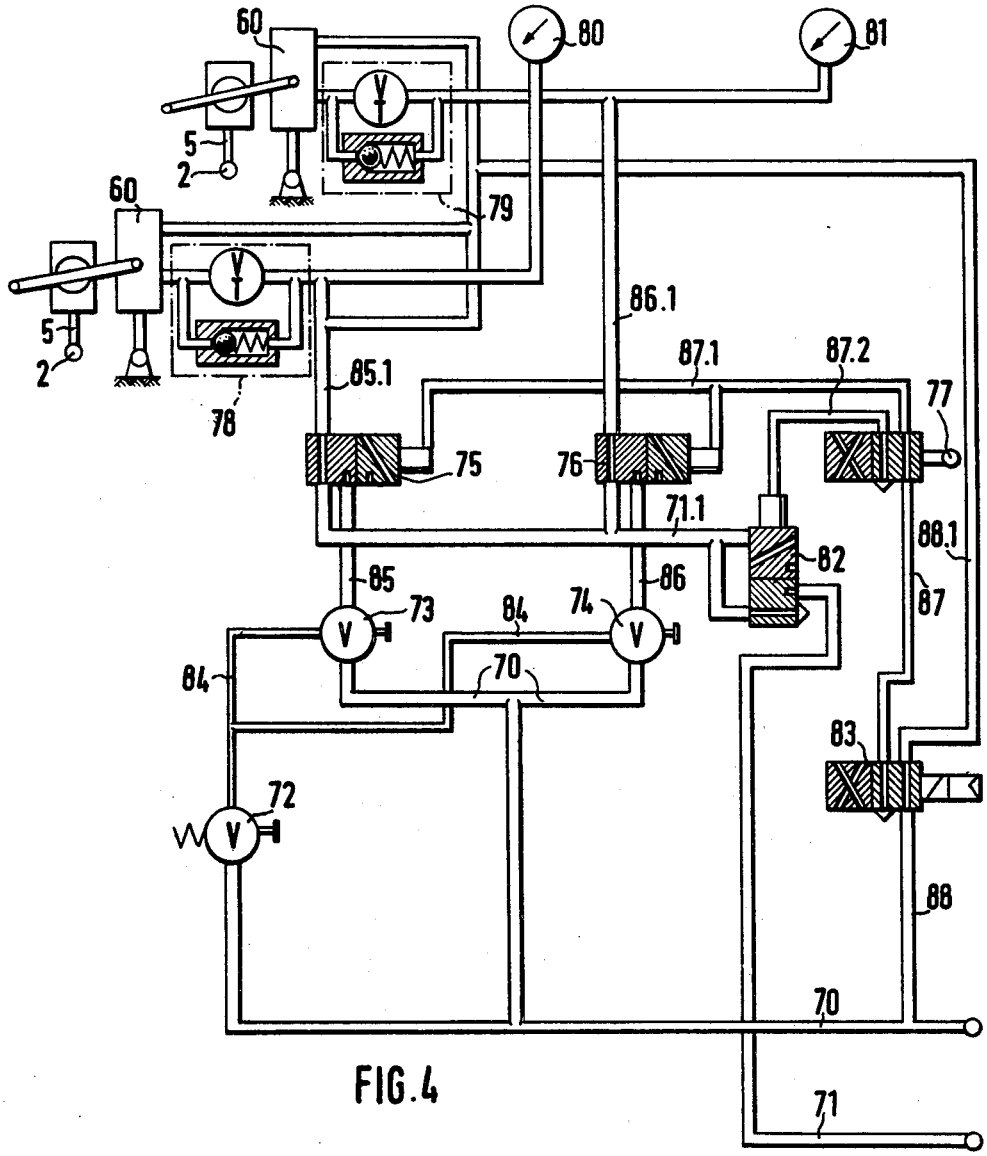
FIG. 4 is a diagram of the pneumatic circuit.
Figure 5:
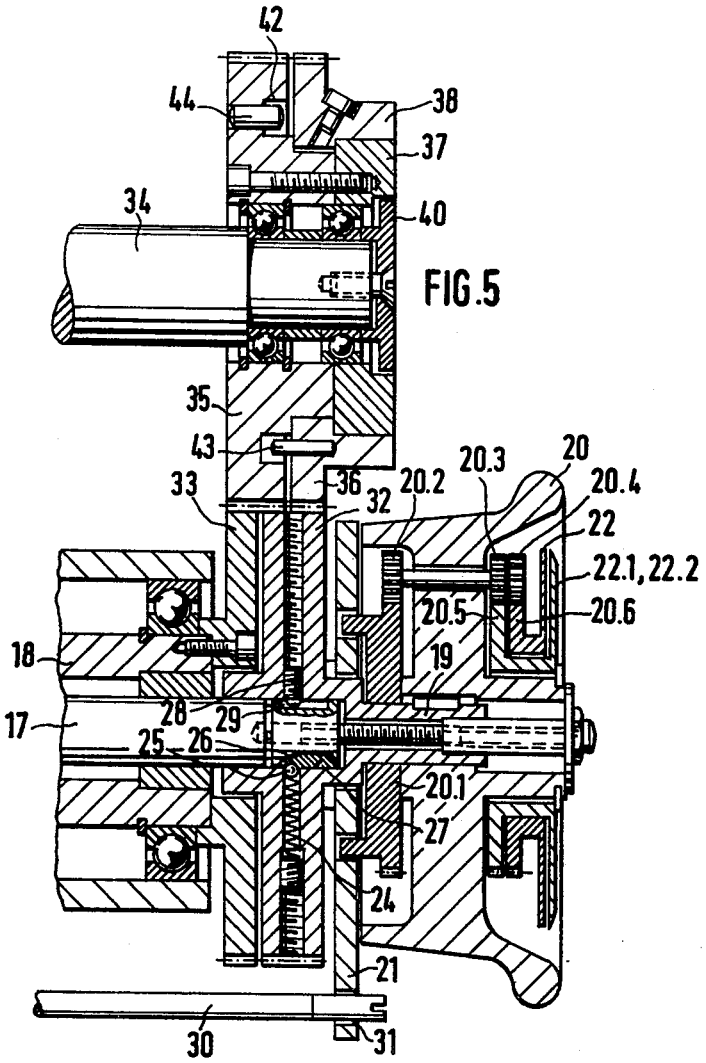
FIG. 5 is an enlarged representation of the FIG. 2 mechanism taken from the side at which the operator stands.

The pneumatic control of the piston-cylinder units 60 is shown in FIG. 4. There are two supply conduits 70, 71 for pressure medium. In the conduit 70 there is pressure medium at about 6 bar and in the conduit 71 pressure medium at about 2 bar. The conduit 70 supplies fine control valves 72, 73 and 74. By means of the fine control valves 73, 74, which can be set in a range of about 0.1 to 2.4 bar, the pressure of one of the piston cylinder units 60 can be controlled for applying the impression cylinder 2 to the plate cylinder 1. The fine control valve 72 can be set from 0 to 6 bar. It is connected to the fine control valves 73, 74 by conduits 84 and regulates the basic pressure existing in the conduits 85, 86 leading from the fine control valves 73, 74, the pressure set at the fine control valves 73, 74 being added to the basic pressure. Thus, when a pressure of 3 bar is set in the fine control valve 72, a pressure of 1 bar in the fine control valve 73 and a pressure of 2 bar in the fine control valve 74, the conduit 85 is at a pressure of $3 + 1 = 4$ bar and the conduit 86 is at a pressure of $3 + 2 = 5$ bar. These different pressures correspond to different forces on the impression cylinder 2 and are often necessary in order to balance out the different quality of the stereotype on the plate cylinder 1.

A slide valve 75 is connected to the conduit 85 and a slide valve 76 to the conduit 86. In the conduit 85.1 leading from the slide valve 75 to one piston-cylinder unit 60 there are a throttle 78 with check valve as well as a pressure indicator 80, whilst in the conduit 86.1 leading from the slide valve 76 to the other piston-cylinder unit 60 there are a throttle 79 as well as a pressure indicator 81.

The slide valves 75 and 76 are connected by a conduit 87.1 to a slide valve 77 and by a conduit 87 to a slide valve 83. The conduit 71 leads to a slide valve 82. From there, a conduit 71.1 goes to the slide valves 75 and 76. A conduit 88 is branched off from the conduit 70 to lead to a slide valve 83 and it is extended as a conduit 88.1 leading to the piston-cylinder unit 60, Pressure medium supplied through the conduit 88 or 88.1 impinges on the upper end faces of the pistons of the piston-cylinder unit 60 and causes the impression cylinder 2 to be lifted.

In the FIG. 4 positions of the slide valves 75, 76, 77, 82 and 83, the conduits 77.1, 85.1, 86.1 87.1 and 87.2 are relieved of pressure.

Pressure application of the impression cylinders 2 is initiated by operating the slide valve 83. The conduit 88.1 is thereby relieved of pressure and the slide valves 75, 76 are operated by pressure through the conduits 87.1 and the pressure medium in the conduits 85 and 86 under the previously stated pressures acts by way of the conduits 85.1 and 86.1 on the piston-cylinder units 60 which apply the impression cylinder 2 against the plate cylinder 1 on operation at full load or they apply the abutment surfaces 7.1 against the surfaces 62, depending on how far the nuts 7 are screwed downwardly. In order that during 'abutment operation' the impression cylinder 2 is not subjected to the different pressures of 4 or 5 bar given above by way of example, and in order that lower pressures may become effective, the piston-cylinder units 60 are subjected to the pressure medium of lower pressure available from the conduit 71. During abutment operation, the slide valve 77 is for this purpose switched out of the illustrated position so that the pressure in the conduit 87 acts through the conduit 87.2 on the slide valve 82 and the latter is also switched out of its illustrated position. This causes the conduits 85 or 86 to be blocked from the conduits 85.1 or 86.1 and the low pressure medium flows out of the conduit 71 through the conduit 71.1 into the conduits 85.1 and 86.1 so that both nuts 7 lie with the same low force against the fixed surfaces 62. In order that the piston cylinder units 60 are necessarily subjected to low pressure medium during abutment operation, the slide valve 77 is disposed beneath one of the gears 11. It is actuated when the nut 7 moves beyond a limiting position in the downward direction.

The two positions of the nuts 7 for the two operating conditions of full load or abutment operation can be read off on the scale 22 at indicator markings 22.1 and 22.2 of the hand wheel 20 which are preferably associated with appropriate symbols next to the scale 22. The two indicator markings 22.1 and 22.2 are spaced apart by three scale graduations. In the illustrated example, this corresponds to a circumferential difference of 30 mm so that the abutment surface 7.1 at full load operation is spaced about $30/2 : \pi = 4.77$ mm from the surface 62 fixed with respect to the frame.

With abutment operation, force is transmitted from the nut 8 to the spindle 5 and from there to the nut 7 and then to the frame of the press. The spindle 5 is therefore tightly clamped so that all load conditions can be traversed during rotation of the hand wheel 20 without the play that is normally provided between the nut and the spindle having any effect. The load conditions can be represented by forces (exerted by the impression cylinder 2 on the plate cylinder 1) that are less than, equal to or larger than the weight of the impression cylinder. The middle region can be critical because any available play would necessarily result in wrong settings. By means of the present apparatus, correct settings that have already been found for the impression cylinder can readily again be found when the printing is later repeated, thereby eliminating the search for the correct setting whilst the press is in operation. This represents a saving in time and reduces the amount of wasted printing.

As already mentioned, the printed impression is often different at the ends of the plate cylinder 1. By separately applying the nuts 7, these differences may be balanced out during abutment operation. On full load operation, different forces on the two ends of the impression cylinder 2 can be achieved by controlling the setting of the fine control valves 73 or 74.

We claim:

1. In an intaglio printing press comprising a frame and co-operating plate and impression cylinders rotatably mounted in said frame, said impression cylinder being provided with two journals each of which is operatively connected to respective screwthreaded spindles, apparatus for applying and withdrawing said impression cylinder respectively to and from said plate cylinder, said apparatus comprising first and second rotatable nuts mounted on each said spindle, means coupling said first nut on each spindle for rotation in unison with said second nut but allowing for movement of said first and second nuts with respect to one another in the axial direction corresponding to the play between the said nuts and the screw thread on the said each spindle, a hand wheel, abutment surfaces fixed with respect to the said frame, transmission means comprising shafts and gearing operatively connecting said hand wheel to said first nuts for allowing selective adjustment of each of said first nuts either in unison or independently of one another with corresponding adjustment of the respective said spindles whereby said first nuts can be displaced to be applied to respective said abutment surfaces by operating said hand wheel, and a piston-cylinder unit operatively connected to each said second nut to lift and lower same, means for supplying said piston-cylinder units with pressure medium through independent fine control valves.

2. The apparatus defined in claim 1, wherein said supplying means includes a basic fine control valve upstream of said independent fine control valves.

3. The apparatus defined in claim 1, wherein a slide valve is disposed in the path of said first nut for switching the supply of said pressure medium from a high pressure to a lower pressure.

4. The apparatus defined in claim 1, further including a movable scale and indicator display with means, including gearing, for coupling said hand wheel to said movable scale for the purpose of adjusting both said first nuts in unison.

5. The apparatus defined in claim 4, wherein said scale is graduated in fractions of the circumference of said plate cylinder.

6. The apparatus defined in claim 1, further including a movable scale and indicator, said scale being graduated in fractions of one revolution of said hand wheel and wherein said hand wheel is coupled by further gearing to said movable scale and indicator.

7. The apparatus defined in claim 6, wherein said transmission means includes means for retracting said hand wheel to a position at which only one said first nut is driven and said further gearing displaces an indicator towards said scale.

8. The apparatus defined in claim 6, wherein said further gearing includes locking means in the form of pins for limiting the amount of said adjustment.

* * * * *